United States Patent [19]

Takao et al.

[11] 4,088,476

[45] May 9, 1978

[54] ABRASION-RESISTANT CAST IRONS

[75] Inventors: Tsutomu Takao, Tokyo; Kentaro Takahashi, Ohmiya, both of Japan

[73] Assignee: Nippon Piston Ring Co., Ltd., Tokyo, Japan

[21] Appl. No.: 737,131

[22] Filed: Oct. 29, 1976

[30] Foreign Application Priority Data

Oct. 29, 1975 Japan ..... 50-130130

[51] Int. Cl.[2] ..... C22C 37/04

[52] U.S. Cl. ..... 75/123 CB; 75/123 B

[58] Field of Search ..... 75/123 B, 123 CB, 128 D, 75/126 A; 148/35

[56] References Cited

U.S. PATENT DOCUMENTS

| | | | |
|---|---|---|---|
| 2,046,912 | 7/1936 | Kormann et al. | 75/123 CB |
| 2,390,594 | 12/1945 | Krause | 75/123 CB |
| 2,630,382 | 3/1953 | Wasserman | 75/123 CB |
| 3,559,775 | 2/1971 | Miller | 75/123 CB |
| 3,814,597 | 6/1974 | Sholl | 75/123 CB |
| 3,909,252 | 9/1975 | Kuriyama et al. | 75/123 CB |
| 3,977,838 | 8/1976 | Hashimoto et al. | 75/123 B |

FOREIGN PATENT DOCUMENTS

| | | | |
|---|---|---|---|
| 38-11253 | 7/1963 | Japan | 75/123 CB |
| 462,284 | 3/1937 | United Kingdom | 75/123 CB |
| 717,245 | 10/1954 | United Kingdom | 75/123 CB |
| 323,461 | 12/1971 | U.S.S.R. | 75/123 B |
| 360,390 | 12/1972 | U.S.S.R. | 75/123 CB |
| 361,216 | 2/1973 | U.S.S.R. | 75/123 CB |
| 378,489 | 7/1973 | U.S.S.R. | 75/123 CB |

OTHER PUBLICATIONS

"Cast Metals Handbook," American Foundrymen's Society, 1944, Chapter 12, pp. 82–89; Chapter 17, pp. 159–166.

*Primary Examiner*—Arthur J. Steiner

*Attorney, Agent, or Firm*—Sughrue, Rothwell, Mion, Zinn and Macpeak

[57] ABSTRACT

An abrasion-resistant cast iron having extremely good resistances to scuffing and abrasion, comprising a pearlite matrix and 2 to 15% of boron carbide and 2 to 7% of graphite flakes, the percentages being in terms of percent areas. The cast iron is useful, for example, for piston rings and cylinder liners of internal combustion engines.

1 Claim, 6 Drawing Figures

CONSTRUCTION OF PISTON RINGS

ABRASION-RESISTANT CAST IRONS

BACKGROUND OF THE INVENTION

This invention relates to abrasion-resistant cast irons suitable as materials for machine parts which require abrasion resistance, such as piston rings, cylinder liners, cam shafts, or tappets.

As is well known, there are various kinds of abrasion-resistant cast irons, and those now in use are classified into white cast iron and mottled cast iron which are high alloy cast irons and gray cast iron which is a low alloy cast iron. Usages of the white iron and gray iron are clearly differentiated from the standpoint of the mode of wear and abrasion. The abrasion-resistant cast irons of this invention belong to the gray iron, but also include mottled iron.

The gray iron, as is well known, consists of a matrix structure composed of pearlite, ferrite, or martensite, etc., graphite flakes, carbides, and others. Various investigations have been undertaken as to the effects of the graphite structure and the matrix structure on abrasion-resisting characteristics, and agreement is seen in the results obtained. Researches have also been conducted widely on the effects of the chemical composition of the gray iron on mechanical properties as well as abrasion resistance. But the wearing phenomenon is so complicated that its cause is still unknown in many respects.

The present inventors have found that boron (B) used in very small amounts leads to the formation of a carbide having high hardness which serves to increase abrasion resistance; that steadite ($Fe_3P$ eutectic) observed in phosphorus-containing cast irons contains boron; and therefore that high hardness special steadite composed of Fe-C-P-B serves to increase abrasion-resisting characteristics.

Cast irons containing phosphorus have been used for castings having small thickness because of their improved fluidity. They also have found wide use as low-cost abrasion resistant cast irons because steadite is of relatively high hardness and is effective for increasing abrasion resistance.

As is seen in boron steel, it has been the practice to include a very small amount of boron in steel. Furthermore, although based on quite a different basic concept, the addition of boron to cast iron is disclosed in U.S. Pat. No. 2,046,912 directed to hard cast iron alloy, U.S. Pat. No. 2,390,594 directed to heat resistant cast iron, and U.S. Pat. No. 2,630,382 directed to cast iron filler metal.

As graphite present in the structure of cast iron acts as a solid lubricant, it exerts a very great effect on abrasion-resisting charactristics. On the other hand, it is known that graphite in flaky form gives the best result in affording abrasion resistance. Although graphite acts as a solid lubricant, too large an amount of it will result in a reduction in the strength of cast iron. For this reason, the amount of graphite is naturally limited. The carbide is also very effective for abrasion resistance because it has high hardness, high melting point and high strength, and possesses great load-bearing ability. Like graphite, excessive amounts of the carbide cause brittleness to cast iron, and reduce its workability, and hence, there is a limit to its amount.

Internal combustion engines have recently been operated at increasingly higher engine speeds and with increasingly higher outputs, and their component parts, such as piston rings or cylinder liners, are required to have both a high level of scuffing resistance and abrasion resistance. However, conventional internal combustion engine parts have a critical planar pressure, with regard to scuffing resistance, of about 25 kg/cm$^2$, and an amount of wear of about 0.046 mg/cm$^2$·km with regard to abrasion resistance, and are still unsatisfactory.

SUMMARY OF THE INVENTION

It is an object of this invention therefore to provide abrasion-resistant cast irons which when used as slidably moving parts of internal combustion engines, can exhibit a critical planar pressure of at least 30 kg/cm$^2$ and an amount of wear of not more than about 0.035 mg/cm$^2$·km.

According to this invention, there is provided an abrasion-resistant cast iron comprising a pearlite matrix, 2 to 15%, as an area ratio, of a boron-containing carbide, and 2 to 7%, as an area ratio, of graphite flakes.

DETAILED DESCRIPTION OF THE INVENTION

Figure 1:
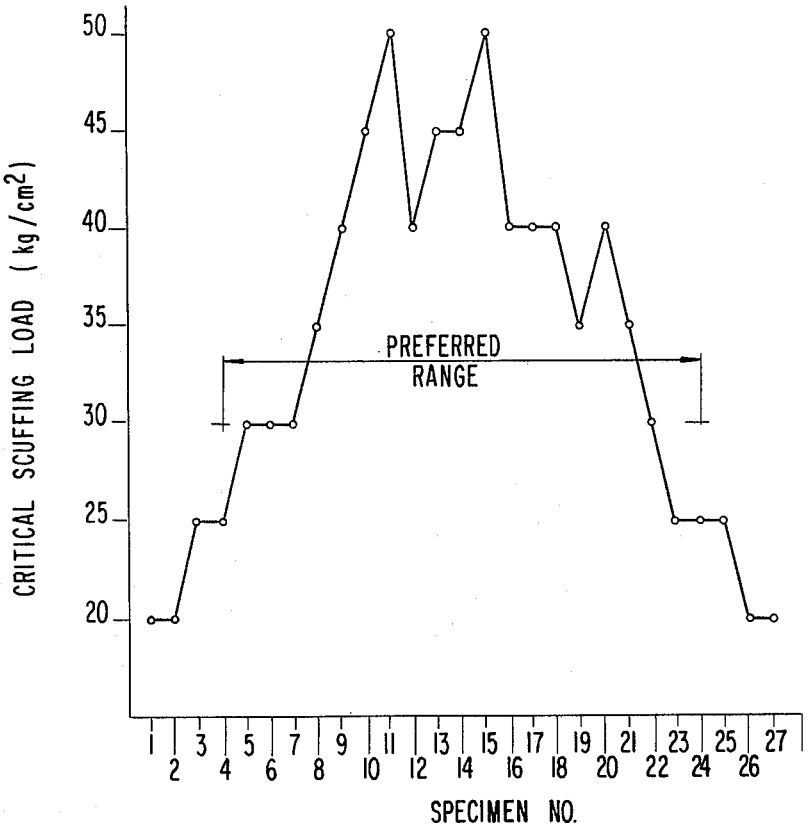
FIG. 1 is a graphic representation showing the critical scuffing loads of specimens having different contents of graphite and boron carbide.

Various investigations have been conducted and reported about cast irons described above. However, there have been few investigations on the effects of the amounts of graphite and carbides on the abrasion-resisting characteristics of cast irons, and almost none have been reported about boron carbide.

Accordingly, the present inventors took a particular interest in the amounts (area ratios) of boron carbide and graphite based on a pearlite matrix, and have extensively worked to find out quantitative ranges which would give the best abrasion resistance. The results of the work are given below.

Specimens Nos. 1 to 27 having different proportions (percent areas) of graphite and carbide based on a pearlite matrix were prepared, and subjected to a scuffing test and a test for the amount of wear. It is quite natural from a metallurgical viewpoint that if the amount of the carbide is large, the amount of graphite decreases. This, however, is also dependent on the chemical composition of a raw material and the rate of cooling, and in order to obtain materials having a predetermined level of quality, these factors should be controlled. Specifically, these specimens were prepared by heat-melting pig iron, scrap steel, ferrosilicon, ferromanganese, ferrophosphor, and ferroboron as raw material to 1450° C in a high-frequency electric furnace, tapping the molten material, inoculating calcium silicide in it, casting the molten material at 1,330° C into a green sand mold with a size of 15 × 20 × 250 mm adapted to withdraw an as-cast material, cooling the casting, and cutting pieces from it for wear tests.

Both the scuffing test and the wear test were performed using a planar contact sliding wear tester (the size of a rotating piece: 135 (outside diameter) × 105 (inside diameter) × 7 (thickness) mm).

Each of the test specimens had a size of 12 (length) × 18 (width) × 5 (thickness) mm.

The scuffing test was performed by increasing the planar pressure from 20 kg/cm² by 5 kg/cm², and the critical load value of scuffing was ascertained by a rise in the temperature of the specimen, variations in the current of the motor torque, and the occurrence of white smoke.

As regards the test for the amount of wear, the test specimen was dipped in a lubricating oil prior to the testing, and its weight was measured. The dipped specimen was then subjected to the wear tester, and its weight was again measured. Changes in weight were then determined. A chemical balance was used for weight measurement.

These tests were performed under the conditions shown in Table 1, and the results obtained are shown in Table 2.

Table 1

| | Scuffing test | Test for the amount of wear |
|---|---|---|
| Sliding speed (m/sec) | 5 | 5 |
| Planar pressure | Increasing by 5 kg/cm² from 20 kg/cm² | 15 kg/cm² |
| Lubricating oil | Daphne oil #65 + kerosene (1:1) | Daphne oil #65 + kerosene (1:1) |
| Oil temperature (° C) | 50 | 50 |
| Amount of oil (liters/min.) | 0.2 | 0.2 |
| Time | 1 hour | 100 km |

Table 2

| Specimen No. | Amount of graphite (area %) | Amount of carbide (area %) | Test results: Critical scuffing load (kg/cm²) | Test results: Amount of wear (kg/cm² · km) |
|---|---|---|---|---|
| 1 | 1.2 | 18.3 | 20 | 0.043 |
| 2 | 1.0 | 14.5 | 20 | 0.046 |
| 3 | 1.3 | 15.6 | 25 | 0.038 |
| 4 | 2.1 | 15.2 | 25 | 0.031 |
| 5 | 2.3 | 14.9 | 30 | 0.030 |
| 6 | 2.0 | 12.7 | 30 | 0.034 |
| 7 | 2.4 | 10.8 | 30 | 0.030 |
| 8 | 2.4 | 8.7 | 35 | 0.029 |
| 9 | 2.6 | 11.4 | 40 | 0.027 |
| 10 | 3.1 | 9.6 | 45 | 0.028 |
| 11 | 3.4 | 8.4 | 50 | 0.028 |
| 12 | 2.9 | 7.9 | 40 | 0.027 |
| 13 | 4.1 | 6.3 | 45 | 0.024 |
| 14 | 4.1 | 5.8 | 45 | 0.027 |
| 15 | 4.4 | 5.9 | 50 | 0.022 |
| 16 | 5.3 | 4.1 | 40 | 0.029 |
| 17 | 4.9 | 4.8 | 40 | 0.028 |
| 18 | 5.0 | 3.8 | 40 | 0.032 |
| 19 | 6.1 | 3.9 | 35 | 0.029 |
| 20 | 6.3 | 2.8 | 40 | 0.030 |
| 21 | 6.3 | 3.1 | 35 | 0.033 |
| 22 | 7.0 | 2.4 | 30 | 0.033 |
| 23 | 7.1 | 1.8 | 25 | 0.038 |
| 24 | 7.9 | 1.7 | 25 | 0.046 |
| 25 | 8.2 | 1.4 | 25 | 0.047 |
| 26 | 8.8 | 1.5 | 20 | 0.048 |
| 27 | 8.9 | 1.1 | 20 | 0.048 |

Figure 2:
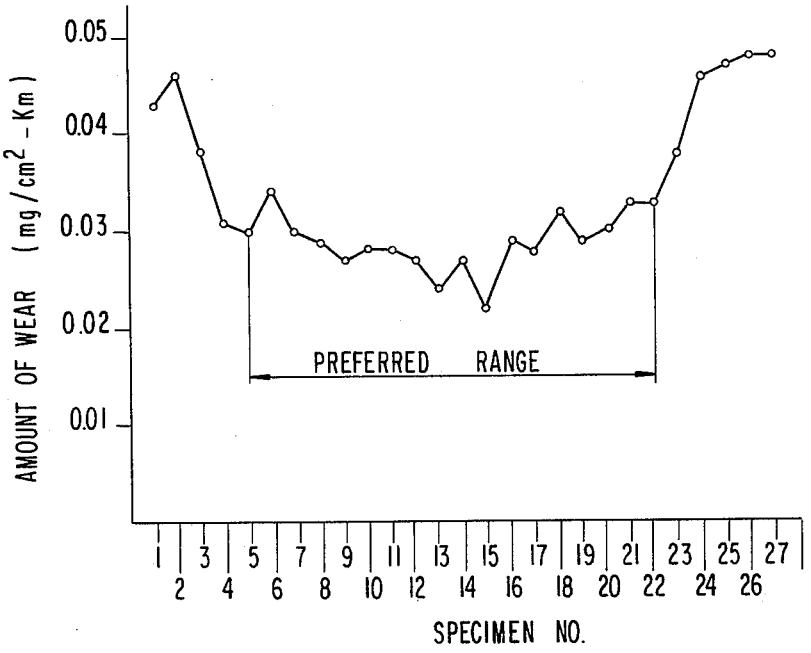
FIG. 2 is a graphic representation showing the amounts of wear of specimens having different contents of graphite and boron carbide.

The measured values shown in Table 2 are plotted in FIGS. 1 and 2. It is clear from FIG. 1 that Specimens Nos. 5 to 22 are within the range where the critical scuffing planar pressure is at least 30 kg/cm² as intended by the present invention. FIG. 2 also shows that Specimens Nos. 5 to 22 are within the range intended by the invention. In these ranges, the cast iron contains 2 to 7% of graphite and 2 to 15% of the carbide.

Figure 3:
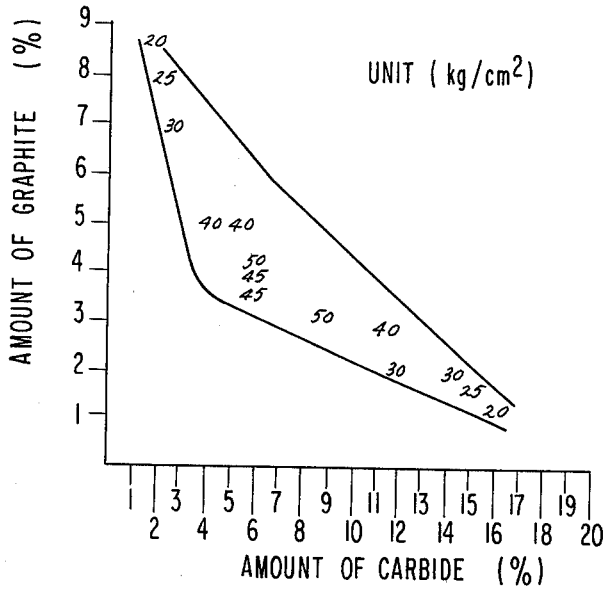
FIGS. 3 and 4 are diagrams showing the distributions of the critical scuffing loads and the amounts of wear respectively, in which the axis of abscissas show the amount (percent area) of the carbide and the axis of ordinates, the amount (percent area) of graphite.
Figure 4:
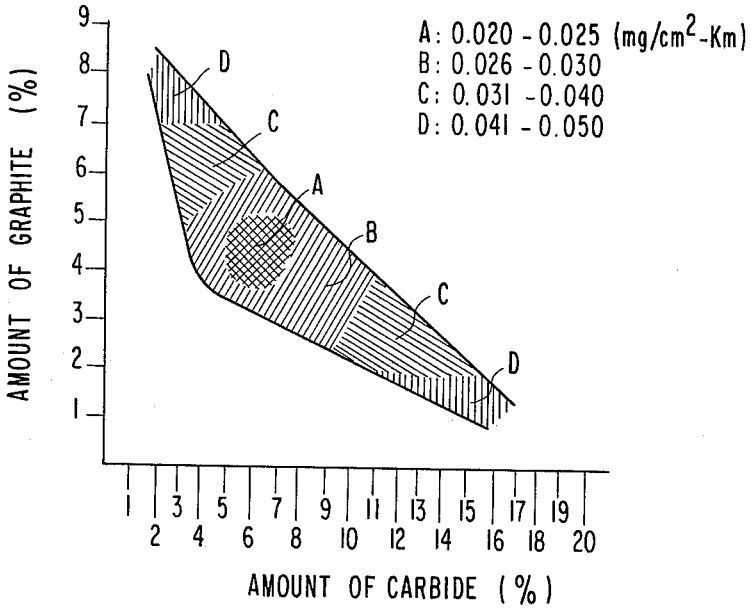

FIGS. 3 and 4 show the distributions of the critical scuffing load values and the amounts of wear with regard to the amount of graphite on the axis of abscissas and the amount of the carbide on the axis of ordinates. It can be seen from FIG. 3 that the region where the critical scuffing load value is at least 30 kg/cm² is within a range where the amount of graphite is about 2 to 7% and the amount of the carbide is about 2 to 15%. In FIG. 4, the range of the amounts of wear is shown in portions A, B, C and D. It is seen that in the feasible ranges A, B and C of the amounts of wear, the amount of graphite is about 2 to 7%, and the amount of the carbide is about 2 to 15%, as in FIG. 3.

In order to compare the amount of wear of the cast iron of this invention (as an example, one containing 4.63% of graphite and 6.56% of carbide was used) with that of a conventional standard liner, liners having the specifications shown in Table 4 were prepared. These liners were mounted in an engine of the specification shown in Table 3, and a service test was conducted.

Table 3

| | |
|---|---|
| Type | water-cooled four-stroke cycle diesel |
| Cylinder number and arrangement | 6 cylinders series-connected |
| Stroke volume | 9800 cc |
| Maximum output | 190/23250 ps/rpm |

Table 4

| Chemical composition | Liner of the invention | Comparative standard liner |
|---|---|---|
| T.C. | 3.52 | 3.55 |
| Si | 1.91 | 2.02 |
| Mn | 0.56 | 0.60 |
| P | 0.33 | 0.25 |
| B | 0.06 | — |
| Graphite amount (%) | 4.63 | 4.50 |
| Carbide amount (%) | 6.56 | Steadite (1.77) |
| Hardness (HRB) | 92.0 | 94.5 |
| Structure | A-type flaky graphite, pearlite matrix, carbide | A-type flaky graphite, pearlite matrix, steadite |
| Remainder | Fe | Fe |

Figure 6:
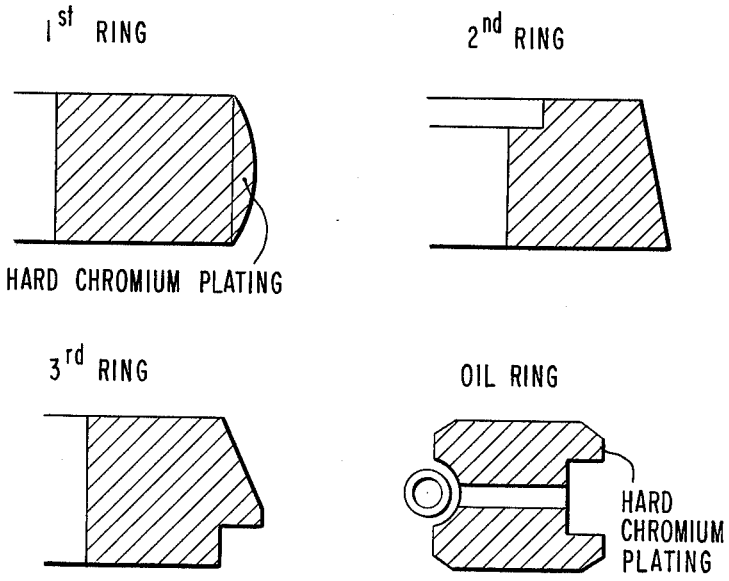
FIG. 6 is a view showing the structures of piston rings used in the service test described hereinbelow.

These liners were combined with piston rings of the structures shown in FIG. 6. After the engine was operated for 200 hours at 2350 rpm (at which speed the output was maximum), the amounts of wear of the liners and the piston rings were measured. The results are shown in Table 5.

Table 5

| | Liner | Piston ring (1st) |
|---|---|---|
| Liner of the invention | 6 μ (dia.) | 7 μ (dia.) |
| Comparative liner | 9 | 10 |

The results shown in Table 5 demonstrate that as compared with the comparative standard liner, the liner made of the abrasion-resistant cast iron of this invention undergoes less wear, and moreover, causes less wear of the piston ring.

It will be appreciated from the experimental results given above that abrasion-resistant cast irons having very good scuffing resistance and abrasion resistance characteristics can be obtained by this invention by including 2 to 15%; as an area ratio, of a boron carbide and 2 to 7%, as an area ratio, of graphite flakes in a pearlite matrix.

Figure 5:
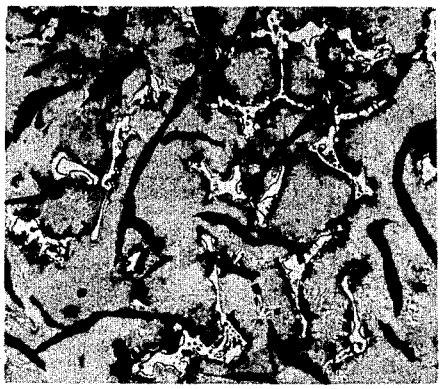
FIG. 5 is a microphotograph of an abrasion-resistant cast iron in accordance with this invention which contains 4% (as area) of graphite and 8% (as area) of a boron containing carbide.

One example of the abrasion-resistant cast iron of this invention which contains 4% (percent area) of graphite and 8% (percent area) of the carbide is microphotographically shown in FIG. 5.

What we claim is:

1. An abrasion-resistant cast iron selected from the group consisting of gray iron and mottled iron consisting of 2 to 15%, as an area ratio, of a boron carbide, 2 to 7%, as an area ratio of graphite and the balance consisting essentially of pearlite.

* * * * *